US007344095B1

(12) United States Patent
Hsu

(10) Patent No.: US 7,344,095 B1
(45) Date of Patent: Mar. 18, 2008

(54) WATER SPRAYER HAVING TWO WATER OUTPUT MANNERS

(75) Inventor: Ming-Yuan Hsu, Changhua Hsien (TW)

(73) Assignee: Da Yuan Sheng Industrial Co., Ltd., Changhua Hsien (TW)

( * ) Notice: Subject to any disclaimer, the term of this patent is extended or adjusted under 35 U.S.C. 154(b) by 53 days.

(21) Appl. No.: 11/339,754

(22) Filed: Jan. 25, 2006

(51) Int. Cl.
*F23D 14/48* (2006.01)

(52) U.S. Cl. ..... 239/589; 239/548; 239/583; 239/444

(58) Field of Classification Search ..... 239/589, 239/583, 548, 436, 438, 459, 440–449, 451
See application file for complete search history.

(56) References Cited

U.S. PATENT DOCUMENTS 5,624,074 A * 4/1997 Parisi ..... 239/588
5,707,011 A * 1/1998 Bosio ..... 239/447
6,045,062 A * 4/2000 Bosio ..... 239/443
6,370,713 B2 * 4/2002 Bosio ..... 4/677
6,738,996 B1 * 5/2004 Malek et al. ..... 4/677
2004/0112985 A1 * 6/2004 Malek et al. ..... 239/445

* cited by examiner

*Primary Examiner*—Kevin Shaver
*Assistant Examiner*—Trevor McGraw
(74) *Attorney, Agent, or Firm*—Alan Kamrath; Kamrath & Associates PA

(57) ABSTRACT

A water sprayer for a faucet includes a housing, a guide member, a valve seat, a nozzle unit, a press button and a valve shaft. Thus, the first nozzle and the second nozzle of the nozzle unit provides two different water output manners so that the water flow is injected outward from the nozzle unit in two different manners according to a user's requirement, thereby facilitating the user operating the water sprayer. In addition, the water flow can be injected outward from the nozzle unit in a stronger or weaker manner and with a larger or smaller area, thereby enhancing the working efficiency and saving the water resource.

16 Claims, 6 Drawing Sheets

WATER SPRAYER HAVING TWO WATER OUTPUT MANNERS

BACKGROUND OF THE INVENTION

1. Field of the Invention

The present invention relates to a water sprayer and, more particularly, to a water sprayer that is mounted on the spout of a faucet, the outlet end of a water pipe or the like.

2. Description of the Related Art

A conventional faucet comprises a spout to inject water outward for use with a user. However, the spout of the faucet only has a single water output manner, so that the water is injected outward from the spout of the faucet in a stronger manner with a smaller area, thereby decreasing the working efficiency and wasting the water resource.

SUMMARY OF THE INVENTION

In accordance with the present invention, there is provided a water sprayer, comprising a housing, a guide member mounted in the housing and having a first portion formed with a water inlet connected to an outside of the housing and a second portion formed with a water outlet connected to the water inlet, a valve seat mounted in the second portion of the guide member and having a first portion formed with a water inlet hole connected to the water outlet of the guide member and a second portion formed with a first water outlet hole connected to the water inlet hole and a second water outlet hole connected to the water inlet hole, a nozzle unit mounted in the housing and having a first nozzle connected to the first water outlet hole of the valve seat, a connecting hole connected to the second water outlet hole and a second nozzle connected to the connecting hole, and a valve shaft movably mounted on the guide member and having a first portion extended into the valve seat and formed with a stop portion.

The primary objective of the present invention is to provide a water sprayer having two different water output manners.

Another objective of the present invention is to provide a water sprayer, wherein the first nozzle and the second nozzle of the nozzle unit provides two different water output manners so that the water flow is injected outward from the nozzle unit in two different manners according to a user's requirement, thereby facilitating the user operating the water sprayer.

A further objective of the present invention is to provide a water sprayer, wherein the water flow can be injected outward from the nozzle unit in a stronger or weaker manner and with a larger or smaller area, thereby enhancing the working efficiency and saving the water resource.

Further benefits and advantages of the present invention will become apparent after a careful reading of the detailed description with appropriate reference to the accompanying drawings.

DETAILED DESCRIPTION OF THE INVENTION

Figure 1:
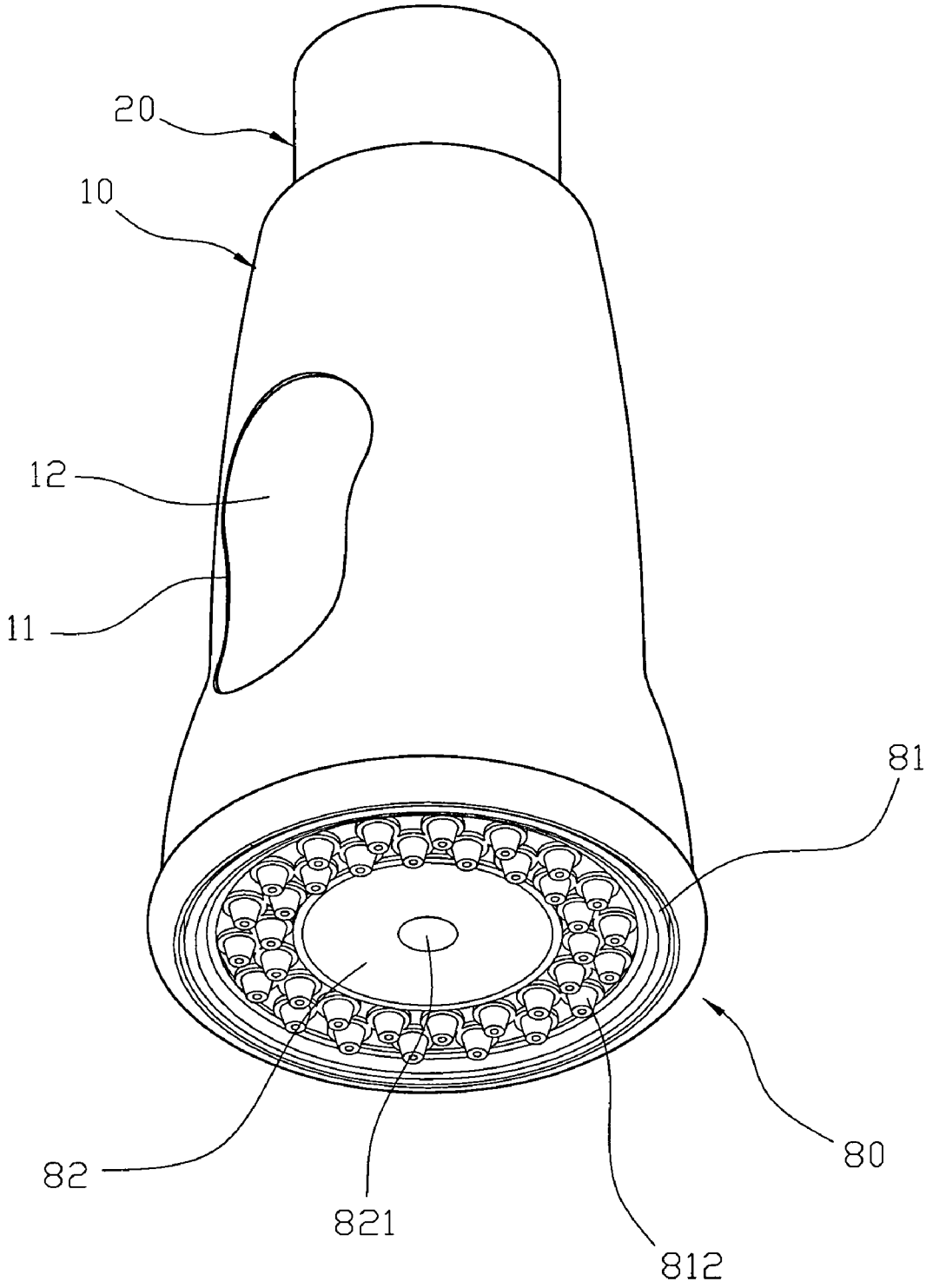
FIG. 1 is a perspective view of a water sprayer in accordance with the preferred embodiment of the present invention.
Figure 2:
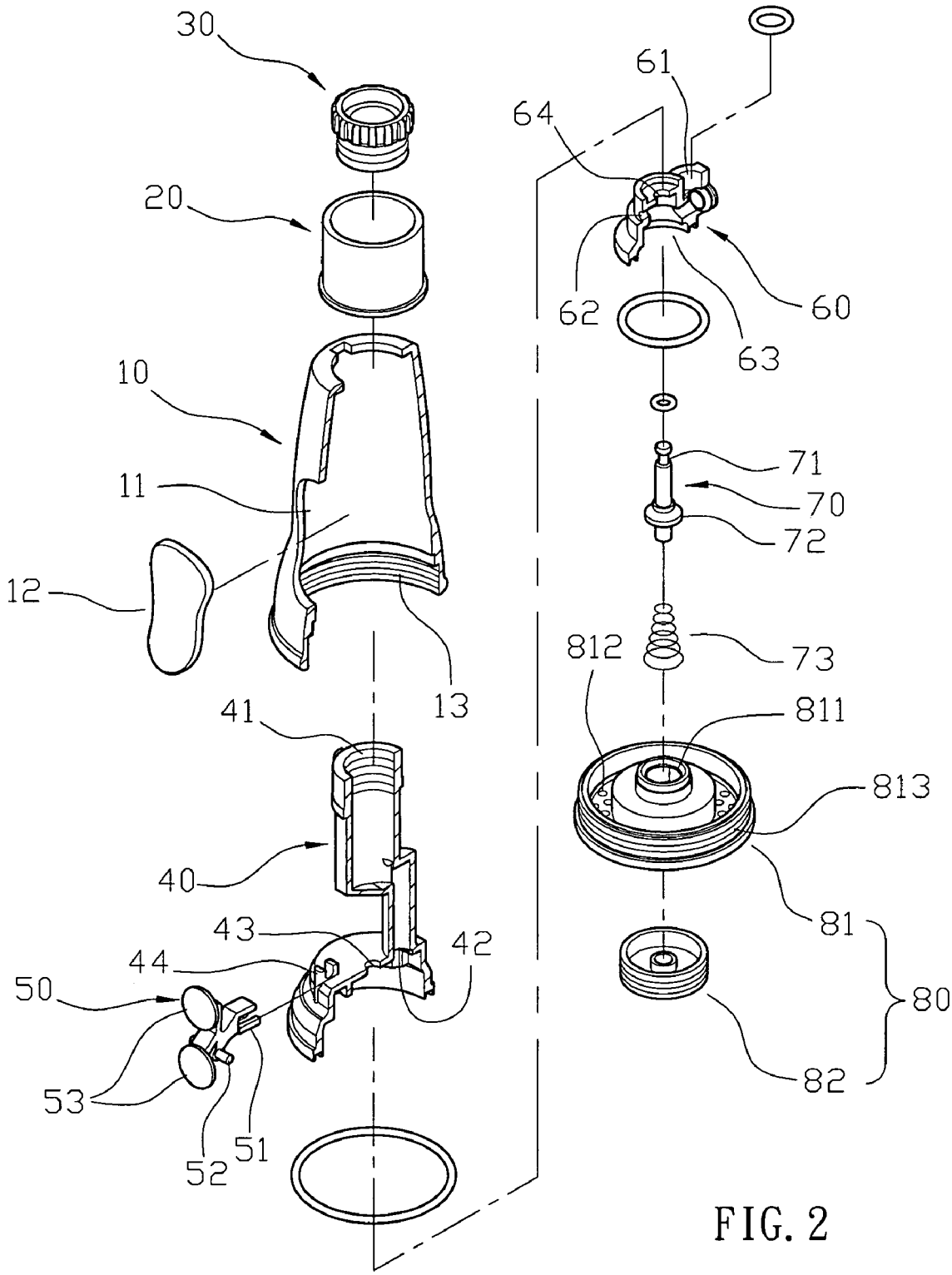
FIG. 2 is an exploded perspective view of the water sprayer as shown in FIG. 1.
Figure 3:
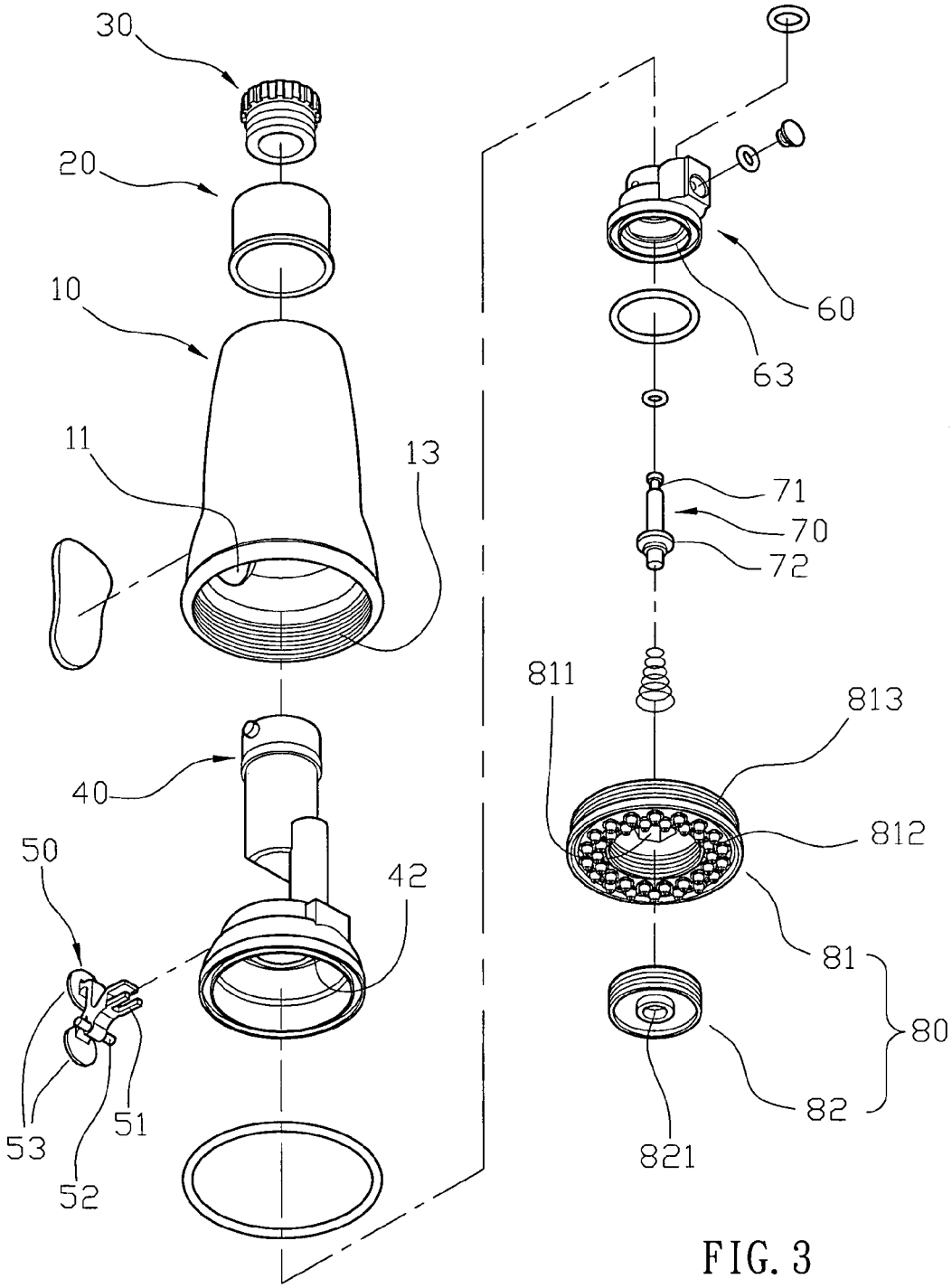
FIG. 3 is another exploded perspective view of the water sprayer as shown in FIG. 1.
Figure 4:
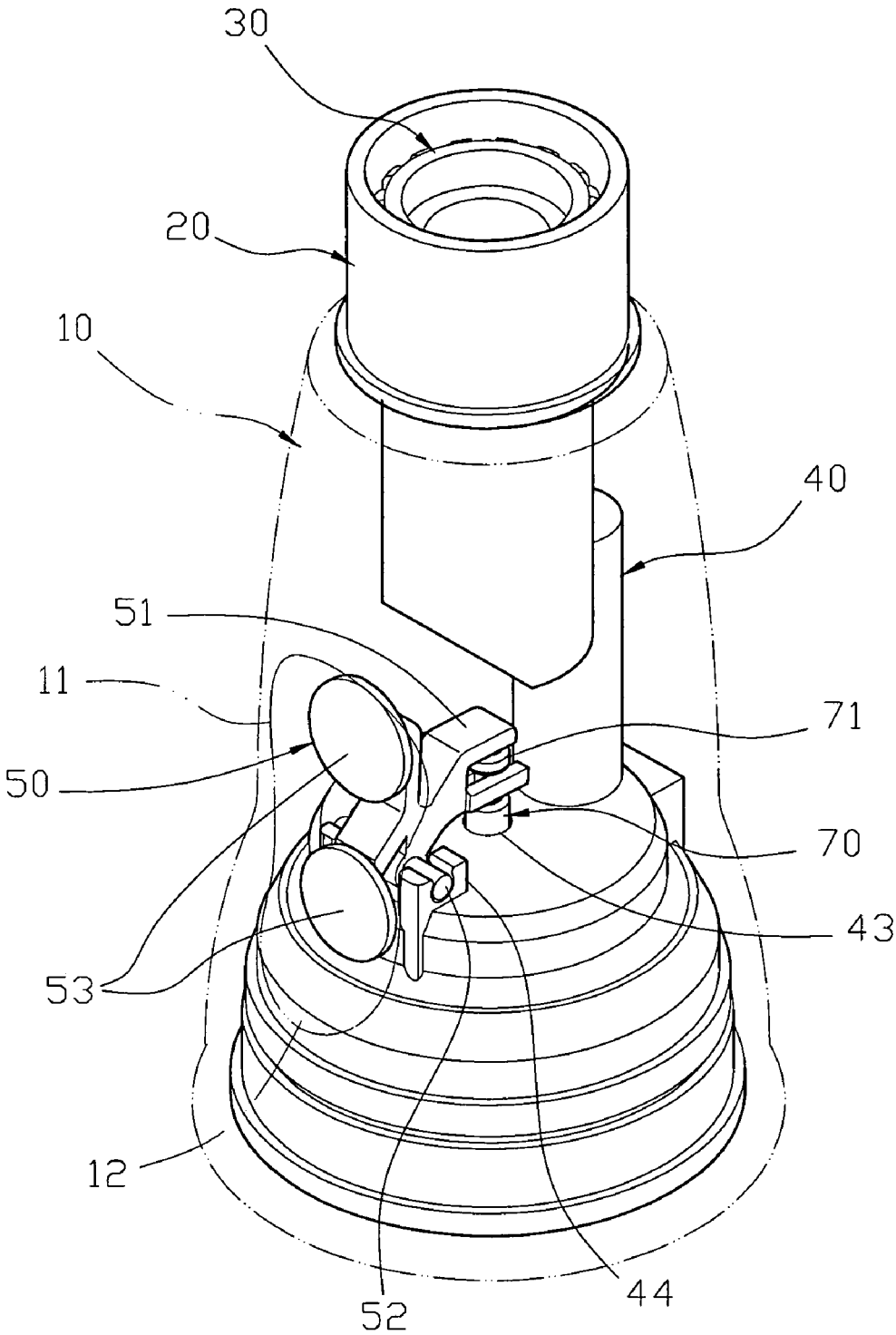
FIG. 4 is a partially perspective view of the water sprayer as shown in FIG. 1.

Referring to the drawings and initially to FIGS. 1-5, a water sprayer for a faucet in accordance with the preferred embodiment of the present invention comprises a housing 10, a guide member 40 mounted in the housing 10 and having a first portion formed with a water inlet 41 connected to an outside of the housing 10 and a second portion formed with a water outlet 42 connected to the water inlet 41, a valve seat 60 mounted in the second portion of the guide member 40 and having a first portion formed with a water inlet hole 61 connected to the water outlet 42 of the guide member 40 and a second portion formed with a first water outlet hole 62 connected to the water inlet hole 61 and a second water outlet hole 63 connected to the water inlet hole 61, a nozzle unit 80 mounted in the housing 10 and having a first nozzle 812 connected to the first water outlet hole 62 of the valve seat 60, a connecting hole 811 connected to the second water outlet hole 63 and a second nozzle 821 connected to the connecting hole 811, a valve shaft 70 movably mounted on the guide member 40 and having a first portion extended into the valve seat 60 and formed with a stop portion 72 and a second portion extended into the housing 10 and formed with a driven portion 71, and a press button 50 pivotally mounted in the housing 10 and having a first portion formed with a drive portion 51 pivotally mounted on the driven portion 71 of the valve shaft 70 to drive and move the valve shaft 70 and a second portion formed with two opposite press portions 53.

Figure 5:
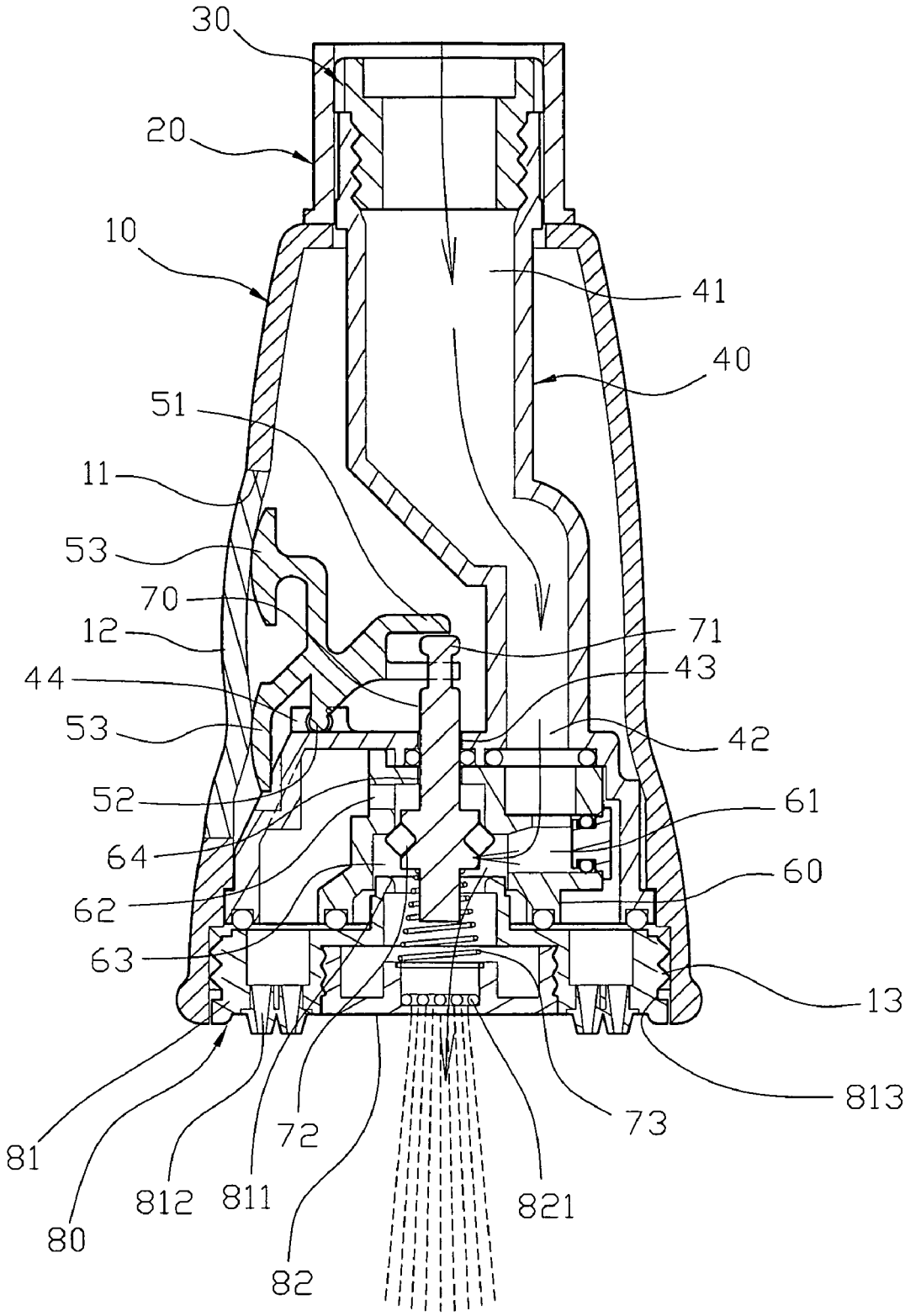
FIG. 5 is a plan cross-sectional operational view of the water sprayer as shown in FIG. 1.
Figure 6:
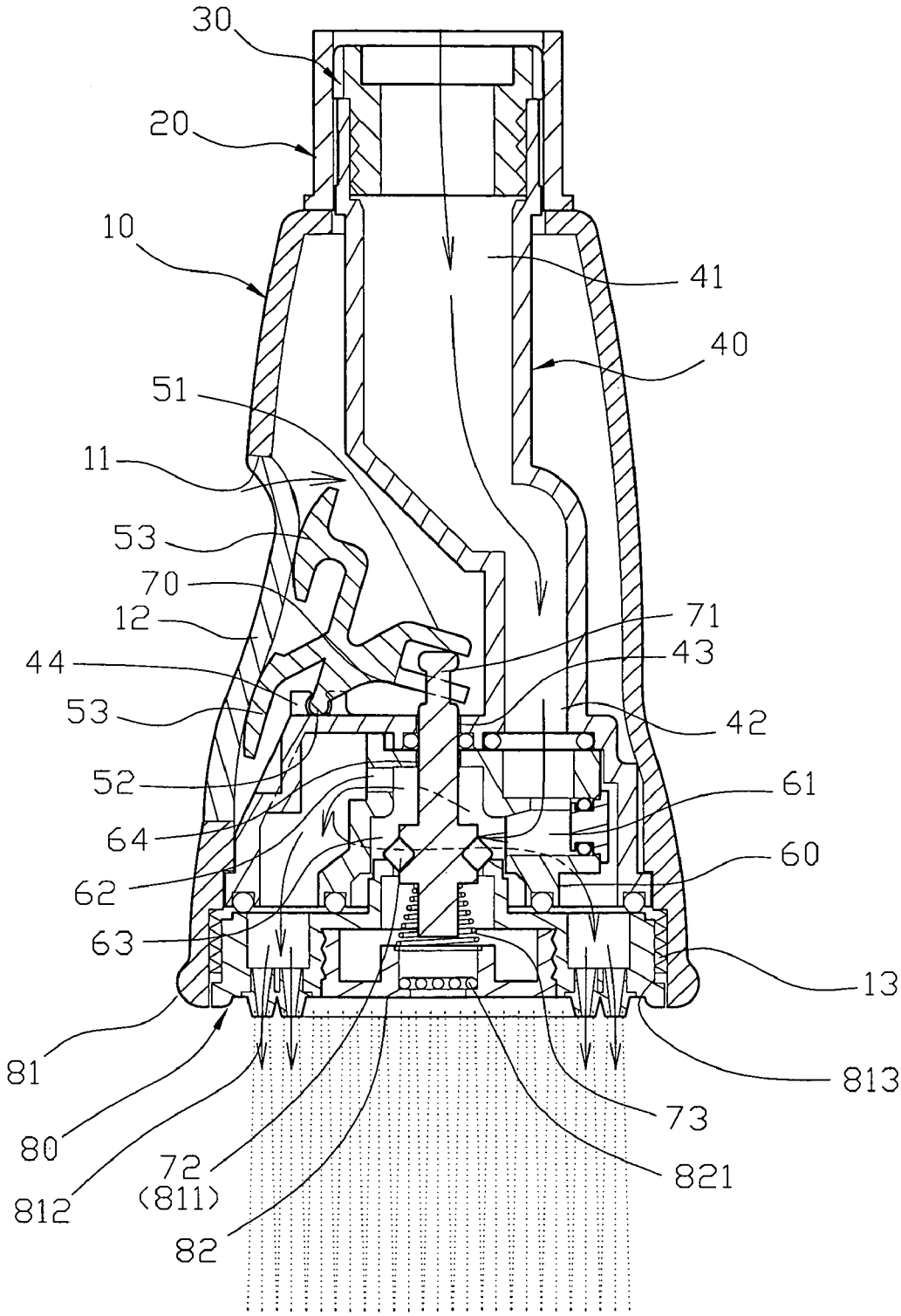
FIG. 6 is a plan cross-sectional operational view of the water sprayer as shown in FIG. 1.

Thus, the valve shaft 70 is movable between a first position where the stop portion 72 of the valve shaft 70 closes a connection between the first water outlet hole 62 and the water inlet hole 61 of the valve seat 60 and opens a connection between the second water outlet hole 63 and the water inlet hole 61 of the valve seat 60 so that a water flow from the water inlet hole 61 of the valve seat 60 in turn flows through the second water outlet hole 63 of the valve seat 60, the connecting hole 811 and the second nozzle 821 of the nozzle unit 80 and is injected outward from the second nozzle 821 of the nozzle unit 80 as shown in FIG. 5, and a second position where the stop portion 72 of the valve shaft 70 opens a connection between the first water outlet hole 62 and the water inlet hole 61 of the valve seat 60 and closes a connection between the second water outlet hole 63 and the connecting hole 811 of the nozzle unit 80 so that the water flow from the water inlet hole 61 of the valve seat 60 in turn flows through the first water outlet hole 62 of the valve seat 60 and the first nozzle 812 of the nozzle unit 80 and is injected outward from the first nozzle 812 of the nozzle unit 80 as shown in FIG. 6.

The housing 10 has a side formed with an opening 11 to expose the press button 50, and a movable lid 12 is mounted in the opening 11 of the housing 10 and rested on the press portions 53 of the press button 50 to drive the press button 50 to pivot on the guide member 40. The housing 10 has a lower portion formed with an inner thread 13. A sleeve 20 is mounted on an upper portion of the housing 10, and a fastening member 30 is mounted in the sleeve 20 and secured to the water inlet 41 of the guide member 40 to secure the guide member 40 in the housing 10.

The second portion of the guide member 40 has a side formed with a shaft hole 43 and a periphery formed with an outwardly protruding pivot seat 44. The guide member 40 has a bent mediate portion so that the water outlet 42 of the guide member 40 is deflected from the water inlet 41 of the guide member 40.

The valve seat 60 has a mediate portion formed with a shaft hole 64.

The valve shaft 70 is movably mounted in the shaft hole 43 of the guide member 40 and the shaft hole 64 of the valve seat 60.

A restoring spring 73 is mounted on the valve shaft 70 and biased between the stop portion 72 of the valve shaft 70 and the nozzle unit 80 to push the stop portion 72 of the valve shaft 70 toward the valve seat 60 to close the connection between the first water outlet hole 62 and the water inlet hole 61 of the valve seat 60 and to open the connection between the second water outlet hole 63 and the water inlet hole 61 of the valve seat 60 at a normal state as shown in FIG. 5.

The press button 50 is pivotally mounted on the guide member 40 and has a mediate portion formed with a pivot shaft 52 pivotally mounted on the pivot seat 44 of the guide member 40.

The nozzle unit 80 includes a first faceplate 81 mounted in the housing 10 and a second faceplate 82 mounted in the first faceplate 81, wherein the first faceplate 81 has a central portion formed with the connecting hole 811 and a peripheral wall formed with the first nozzle 812, and the second faceplate 82 has a central portion formed with the second nozzle 821. Thus, the first nozzle 812 and the second nozzle 821 of the nozzle unit 80 provides two different water output manners. The first faceplate 81 of the nozzle unit 80 has an outer wall formed with an outer thread 813 screwed into the inner thread 13 of the housing 10.

When in use, the water sprayer is mounted on the spout of a faucet, the outlet end of a water pipe or the like to allow the water flowing into the water inlet 41 of the guide member 40. Then, the water flows through the water outlet 42 of the guide member 40 into the water inlet hole 61 of the valve seat 60.

As shown in FIG. 5, when the valve shaft 70 is movable upward to the first position by the elastic force of the restoring spring 73, the stop portion 72 of the valve shaft 70 closes the connection between the first water outlet hole 62 and the water inlet hole 61 of the valve seat 60 and opens the connection between the second water outlet hole 63 and the water inlet hole 61 of the valve seat 60 so that the water flow from the water inlet hole 61 of the valve seat 60 in turn flows through the second water outlet hole 63 of the valve seat 60, the connecting hole 811 and the second nozzle 821 of the nozzle unit 80 and is injected outward from the second nozzle 821 of the nozzle unit 80.

As shown in FIG. 6, when the valve shaft 70 is movable downward to the second position by pressing an upper one of the press portions 53 of the press button 50 to overcome the elastic force of the restoring spring 73, the stop portion 72 of the valve shaft 70 opens the connection between the first water outlet hole 62 and the water inlet hole 61 of the valve seat 60 and closes the connection between the second water outlet hole 63 and the connecting hole 811 of the nozzle unit 80 so that the water flow from the water inlet hole 61 of the valve seat 60 in turn flows through the first water outlet hole 62 of the valve seat 60 and the first nozzle 812 of the nozzle unit 80 and is injected outward from the first nozzle 812 of the nozzle unit 80.

At this time, the water pressure from the water inlet hole 61 of the valve seat 60 overcomes the elastic force of the restoring spring 73, so that the water flow from the water inlet hole 61 of the valve seat 60 is injected outward from the first nozzle 812 of the nozzle unit 80 constantly.

After the water flow from the water inlet hole 61 of the valve seat 60 is closed, the valve shaft 70 is movable upward to the first position by the restoring force of the restoring spring 73, so that the valve shaft 70 is returned to the original normal state, that is, the water flow from the water inlet hole 61 of the valve seat 60 is injected outward from the second nozzle 821 of the nozzle unit 80 at the next time.

Accordingly, the first nozzle 812 and the second nozzle 821 of the nozzle unit 80 provides two different water output manners so that the water flow is injected outward from the nozzle unit 80 in two different manners according to a user's requirement, thereby facilitating the user operating the water sprayer. In addition, the water flow can be injected outward from the nozzle unit 80 in a stronger or weaker manner and with a larger or smaller area, thereby enhancing the working efficiency and saving the water resource.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A water sprayer, comprising:

a housing;

a guide member mounted in the housing and having a first portion formed with a water inlet connected to an outside of the housing and a second portion formed with a water outlet connected to the water inlet;

a valve seat mounted in the second portion of the guide member and having a first portion formed with a water inlet hole connected to the water outlet of the guide member and a second portion formed with a first water outlet hole connected to the water inlet hole and a second water outlet hole connected to the water inlet hole;

a nozzle unit mounted in the housing and having a first nozzle connected to the first water outlet hole of the valve seat, a connecting hole connected to the second water outlet hole of the valve seat and a second nozzle connected to the connecting hole;

a valve shaft movably mounted on the guide member and having a first portion extended into the valve seat and formed with a stop portion; wherein the second nozzle of the nozzle unit is located at a central portion of the nozzle unit;

the first nozzle of the nozzle unit surrounds a periphery of the second nozzle of the nozzle unit;

the connecting hole of the nozzle unit is located and connected between the second nozzle of the nozzle unit and the second water outlet hole of the valve seat;

the valve shaft is movable between a first position where the stop portion of the valve shaft closes a connection between the first water outlet hole and the water inlet hole of the valve seat and opens a connection between the second water outlet hole and the water inlet hole of the valve seat so that a water flow from the water inlet hole of the valve seat in turn flows through the second water outlet hole of the valve seat, the connecting hole and the second nozzle of the nozzle unit and is injected outward from the second nozzle of the nozzle unit, and a second position where the stop portion of the valve shaft opens the connection between the first water outlet hole and the water inlet hole of the valve seat and closes a connection between the second water outlet hole and the connecting hole of the nozzle unit so that the water flow from the water inlet hole of the valve seat in turn flows through the first water outlet hole of the valve seat and the first nozzle of the nozzle unit and is injected outward from the first nozzle of the nozzle unit;

the water sprayer further comprises a restoring spring mounted on the valve shaft and biased between the stop portion of the valve shaft and the nozzle unit to push the stop portion of the valve shaft toward the valve seat to close the connection between the first water outlet hole and the water inlet hole of the valve seat and to open the connection between the second water outlet hole and the water inlet hole of the valve seat at a normal state.

2. The water sprayer in accordance with claim 1, further comprising a press button pivotally mounted in the housing and connected to the valve shaft to drive the valve shaft, wherein the press button is fully received in the housing.

3. The water sprayer in accordance with claim 2, wherein the valve shaft has a second portion protruded from the valve seat, extended into the housing and formed with a recessed driven portion, and the press button has a first portion formed with a forked drive portion pivotally mounted on the driven portion of the valve shaft to drive and move the valve shaft relative to the valve seat.

4. The water sprayer in accordance with claim 3, wherein the press button has a second portion formed with two opposite protruding press portions.

5. The water sprayer in accordance with claim 4, wherein the housing has a side formed with an opening to expose the press portions of the press button.

6. The water sprayer in accordance with claim 4, wherein the press button is pivotally mounted on the guide member.

7. The water sprayer in accordance with claim 6, wherein the second portion of the guide member has a periphery formed with an outwardly protruding pivot seat, and the press button has a mediate portion formed with a pivot shaft pivotally mounted on the pivot seat of the guide member.

8. The water sprayer in accordance with claim 5, further comprising a movable lid movably mounted in and flush with the opening of the housing and rested on the press portions of the press button to drive the press button to pivot on the guide member.

9. The water sprayer in accordance with claim 1, wherein the guide member has a bent mediate portion located between the water outlet and the water inlet of the guide member so that the water outlet of the guide member is deflected from the water inlet of the guide member.

10. The water sprayer in accordance with claim 1, wherein the second portion of the guide member has a side formed with a shaft hole, the valve seat has a mediate portion formed with a shaft hole located between the first water outlet hole and the second water outlet hole of the valve seat, and the valve shaft is movably mounted in the shaft hole of the guide member and the shaft hole of the valve seat.

11. The water sprayer in accordance with claim 1, wherein the nozzle unit includes a first faceplate mounted and fully received in the housing and a second faceplate mounted in and located at a central portion of the first faceplate.

12. The water sprayer in accordance with claim 11, wherein the first faceplate has a protruding central portion formed with the connecting hole and a peripheral wall formed with the first nozzle which surrounds the connecting hole, and the second faceplate has a central portion formed with the second nozzle which is separated from and encompassed by the first nozzle.

13. The water sprayer in accordance with claim 1, wherein the first nozzle and the second nozzle of the nozzle unit provides two different water output manners.

14. The water sprayer in accordance with claim 1, wherein the valve shaft is movable upward to the first position at the normal state by an elastic force of the restoring spring.

15. The water sprayer in accordance with claim 1, wherein the nozzle unit is fully received in the housing.

16. The water sprayer in accordance with claim 1, wherein the valve shaft is movable in a direction parallel with an axial direction of the guide member and the housing.

* * * * *